US011780642B2

(12) United States Patent
Chen et al.

(10) Patent No.: US 11,780,642 B2
(45) **Date of Patent: *Oct. 10, 2023**

(54) THREE-PACK BEVERAGE BOX

(71) Applicant: Pratt Corrugated Holdings, Inc., Brookhaven, GA (US)

(72) Inventors: Shifeng Chen, Newport News, VA (US); Greg Sollie, Sharpsburg, GA (US); Jamie Waltermire, Peachtree City, GA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/962,555

(22) Filed: Oct. 10, 2022

(65) Prior Publication Data

US 2023/0033698 A1 Feb. 2, 2023

Related U.S. Application Data

(63) Continuation of application No. 16/903,451, filed on Jun. 17, 2020, now Pat. No. 11,505,364.

(51) Int. Cl.
*B65D 5/66* (2006.01)
*B65D 5/48* (2006.01)
(Continued)

(52) U.S. Cl.
CPC ..... *B65D 5/6605* (2013.01); *B65D 5/0254* (2013.01); *B65D 5/4204* (2013.01);
(Continued)

(58) Field of Classification Search
CPC .. B65D 5/6605; B65D 5/6608; B65D 5/4204; B65D 5/5004; B65D 5/5011;
(Continued)

(56) References Cited

U.S. PATENT DOCUMENTS 1,682,838 A * 9/1928 Feigelman ..... B65D 5/48002 206/782
1,930,235 A * 10/1933 Fox ..... B65D 5/48002 206/427
(Continued)

FOREIGN PATENT DOCUMENTS

EP 3056443 8/2016
EP 3056443 A1 * 8/2016 ..... B65D 5/48014
(Continued)

OTHER PUBLICATIONS

Chen, Shifeng; Corrected Notice of Allowance for U.S. Appl. No. 16/903,440, filed Jun. 17, 2020, dated Jul. 9, 2021, 6 pgs.
(Continued)

*Primary Examiner* — Nathan J Newhouse
*Assistant Examiner* — Phillip D Schmidt
(74) *Attorney, Agent, or Firm* — Taylor English Duma LLP

(57) ABSTRACT

A blank includes a front panel; a wing portion coupled to the front panel by a wing hinge, the wing portion including an attachment panel disposed opposite from the wing hinge, the attachment panel configured to couple to the front panel to at least partially form a cavity between the front panel and the wing portion; a lower telescoping panel coupled to the front panel by a lower telescoping hinge; and an upper telescoping panel coupled to the lower telescoping panel by an upper telescoping hinge, the upper telescoping panel and the lower telescoping panel configured to fold into the cavity in a closed configuration to at least partially enclose the cavity.

20 Claims, 13 Drawing Sheets

(51) Int. Cl.
*B65D 5/02* (2006.01)
*B65D 5/50* (2006.01)
*B65D 5/42* (2006.01)
*B65D 85/30* (2006.01)

(52) U.S. Cl.
CPC ..... *B65D 5/48014* (2013.01); *B65D 5/5011* (2013.01); *B65D 85/30* (2013.01); *B65D 2501/24216* (2013.01)

(58) Field of Classification Search
CPC ..... B65D 5/0254; B65D 5/48002; B65D 5/48014–48016; B65D 5/4802; B65D 5/48–48048
See application file for complete search history.

(56) References Cited

U.S. PATENT DOCUMENTS

| | | | |
|---|---|---|---|
| 2,325,277 | A | 7/1943 | Rothe et al. |
| 2,531,090 | A | 11/1950 | Turner |
| 2,537,151 | A | 1/1951 | Mires |
| 2,719,650 | A | 10/1955 | Buttery et al. |
| 3,119,544 | A | 1/1964 | Cope et al. |
| 3,178,242 | A | 4/1965 | Ellis et al. |
| 3,194,480 | A | 7/1965 | Maindron et al. |
| 3,198,379 | A | 8/1965 | Creelman |
| 3,349,986 | A | 10/1967 | Chapman et al. |
| 3,443,736 | A | 5/1969 | Steinbock |
| 3,827,550 | A | 8/1974 | Arneson |
| 4,010,888 | A | 3/1977 | Gilbert |
| 4,088,262 | A | 5/1978 | Kuehlhorn |
| 4,318,470 | A | 3/1982 | Montealegre |
| D265,723 | S | 8/1982 | Rosenthal |
| 4,377,252 | A | 3/1983 | Schillinger |
| 4,394,905 | A | 7/1983 | Hackenburg |
| 4,482,055 | A | 11/1984 | Boyle |
| D290,343 | S | 6/1987 | Osborne |
| 4,756,469 | A | 7/1988 | Hansen |
| D309,262 | S | 7/1990 | Coiner |
| D318,802 | S | 8/1991 | Egide |
| 5,065,937 | A | 11/1991 | Ritter |
| D329,375 | S | 9/1992 | Bergman |
| 5,186,359 | A | 2/1993 | Brown et al. |
| D360,131 | S | 7/1995 | Tudor |
| D364,087 | S | 11/1995 | Farley |
| 5,584,430 | A | 12/1996 | Mulry |
| 5,680,930 | A | 10/1997 | Stone |
| D461,120 | S | 8/2002 | Ostro |
| 6,755,324 | B2 | 6/2004 | Geshay |
| D495,953 | S | 9/2004 | Miller |
| 7,314,158 | B2 | 1/2008 | McKenna, Sr. et al. |
| 7,578,385 | B2 | 8/2009 | Holley, Jr. |
| D608,634 | S | 1/2010 | Riedi |
| D651,076 | S | 12/2011 | Van Berlo |
| 8,490,785 | B2 | 7/2013 | Brand |
| D690,593 | S | 10/2013 | Kaps et al. |
| 8,746,541 | B2 | 6/2014 | Spivey, Sr. et al. |
| 8,746,543 | B2 | 6/2014 | Jolley et al. |
| D744,332 | S | 12/2015 | D'Anglade |
| D764,315 | S | 8/2016 | Rachocki |
| 9,415,914 | B2 | 8/2016 | Holley, Jr. |
| 9,540,132 | B1 | 1/2017 | Lee |
| D805,894 | S | 12/2017 | Lee |
| 10,301,090 | B2 | 5/2019 | Holley, Jr. |
| 10,414,537 | B2 | 9/2019 | Imai et al. |
| D863,056 | S | 10/2019 | Luna |
| D870,551 | S | 12/2019 | Klesmith |
| D874,268 | S | 2/2020 | Muse et al. |
| D891,920 | S | 8/2020 | Sill et al. |
| 10,730,657 | B1 | 8/2020 | Spencer |
| D913,784 | S | 3/2021 | O'Donnell |
| 11,117,704 | B2 | 9/2021 | Chen et al. |
| 11,447,287 | B2 | 9/2022 | Chen et al. |
| 11,472,596 | B2 | 10/2022 | Chen et al. |
| 11,505,364 | B2 * | 11/2022 | Chen ..... B65D 5/5014 |
| D976,697 | S | 1/2023 | Laine |
| 11,655,064 | B2 | 5/2023 | Chen et al. |
| 2003/0213705 | A1 | 11/2003 | Woog |
| 2006/0097005 | A1 | 5/2006 | Hill et al. |
| 2009/0065559 | A1 | 3/2009 | Parkes |
| 2009/0134210 | A1 | 5/2009 | Li |
| 2010/0147932 | A1 | 6/2010 | Brand |
| 2011/0210035 | A1 | 9/2011 | Dixon et al. |
| 2014/0166519 | A1 | 6/2014 | Alexander |
| 2016/0229581 | A1 | 8/2016 | Smith |
| 2019/0055071 | A1 | 2/2019 | Hayter et al. |
| 2021/0139189 | A1 | 5/2021 | Chen et al. |
| 2021/0371157 | A1 | 12/2021 | Chen et al. |
| 2021/0371158 | A1 | 12/2021 | Chen et al. |
| 2021/0394951 | A1 | 12/2021 | Chen et al. |
| 2021/0394952 | A1 | 12/2021 | Chen et al. |
| 2022/0185533 | A1 | 6/2022 | Chen et al. |
| 2022/0380084 | A1 | 12/2022 | Chen et al. |
| 2023/0249872 | A1 | 8/2023 | Chen et al. |

FOREIGN PATENT DOCUMENTS

| | | | | |
|---|---|---|---|---|
| FR | 2769892 | | 4/1999 | |
| FR | 2769892 | A1 * | 4/1999 | ..... B65D 5/10 |
| FR | 2800714 | | 5/2001 | |
| FR | 2800714 | A1 * | 5/2001 | ..... B65D 5/4802 |
| GB | 390356 | A * | 4/1933 | |
| GB | 2342637 | | 4/2000 | |

OTHER PUBLICATIONS

Chen, Shifeng; Non-Final Office Action for U.S. Appl. No. 16/903,440, filed Jun. 17, 2020, dated Nov. 19, 2020, 12 pgs.
Chen, Shifeng; Notice of Allowance for U.S. Appl. No. 16/903,440, filed Jun. 17, 2020, dated May 13, 2021, 9 pgs.
Chen, Shifeng; Requirement for Restriction/Election for U.S. Appl. No. 16/903,440, filed Jun. 17, 2020, dated Oct. 13, 2020, 6 pgs.
Chen, Shifeng; Non-Final Office Action for U.S. Appl. No. 17/400,695, filed Aug. 12, 2021, dated Jun. 29, 2022, 23 pgs.
Chen, Shifeng; Notice of Allowance for U.S. Appl. No. 17/400,711, filed Aug. 12, 2021, dated Jul. 6, 2022, 22 pgs.
Chen, Shifeng; Non-Final Office Action for U.S. Appl. No. 16/903,451, filed Jun. 17, 2020, dated Mar. 16, 2022, 35 pgs.
Chen, Shifeng; Notice of Allowance for U.S. Appl. No. 16/903,451, filed Jun. 17, 2020, dated Jul. 20, 2022, 9 pgs.
Chen, Shifeng; Non-Final Office Action for U.S. Appl. No. 16/903,460, filed Jun. 17, 2020, dated Feb. 16, 2022, 7 pgs.
Chen, Shifeng; Non-Final Office Action for U.S. Appl. No. 16/903,460, filed Jun. 17, 2020, dated Apr. 12, 2021, 12 pgs.
Chen, Shifeng; Notice of Allowance for U.S. Appl. No. 16/903,460, filed Jun. 17, 2020, dated Oct. 27, 2021, 9 pgs.
Chen, Shifeng; Notice of Allowance for U.S. Appl. No. 16/903,460, filed Jun. 17, 2020, dated May 24, 2022, 9 pgs.
Chen, Shifeng; Requirement for Restriction/Election for U.S. Appl. No. 16/903,460, filed Jun. 17, 2020, dated Jan. 22, 2021, 5 pgs.
Chen, Shifeng; Requirement for Restriction/Election for U.S. Appl. No. 17/682,987, filed Feb. 28, 2022, dated Nov. 2, 2022, 5 pgs.
Chen, Shifeng; Notice of Allowance for Design U.S. Appl. No. 29/753,417, filed Sep. 30, 2020, dated Mar. 22, 2023, 49 pgs.
Chen, Shifeng; Notice of Allowance for Design U.S. Appl. No. 29/753,409, filed Sep. 30, 2020, dated Mar. 22, 2023, 19 pgs.
Chen, Shifeng; Non-Final Office Action for Design U.S. Appl. No. 29/753,406, filed Sep. 30, 2020, dated Mar. 27, 2023, 46 pgs.
Chen, Shifeng; Notice of Allowance for U.S. Appl. No. 29/753,413, filed Sep. 30, 2020, dated Mar. 22, 2023, 49 pgs.
Chen, Shifeng; Non-Final Office Action for Design U.S. Appl. No. 29/753,414, filed Sep. 30, 2020, dated Mar. 23, 2023, 45 pgs.
Chen, Shifeng; Notice of Allowance for U.S. Appl. No. 17/400,695, filed Aug. 12, 2021, dated Jan. 26, 2023, 14 pgs.
Chen, Shifeng; Certificate of Correction for U.S. Appl. No. 16/903,451, filed Jun. 17, 2020, dated Feb. 7, 2023, 1 pg.
Chen, Shifeng; Non-Final Office Action for U.S. Appl. No. 17/682,987, filed Feb. 28, 2022, dated Jan. 4, 2023, 28 pgs.

(56) References Cited

OTHER PUBLICATIONS

Chen, Shifeng; Non-Final Office Action for U.S. Appl. No. 17/885,906, filed Aug. 11, 2022, dated Jan. 10, 2023, 19 pgs.
Chen, Shifeng; Non-Final Office Action for U.S. Appl. No. 17/682,987, filed Feb. 28, 2022, dated Jun. 28, 2023, 20 pgs.
Chen, Shifeng; Non-Final Office Action for U.S. Appl. No. 17/885,906, filed Aug. 11, 2022, dated Jul. 11, 2023, 19 pgs.
Chen, Shifeng; Notice of Allowance for Design U.S. Appl. No. 29/895,791, filed Jun. 26, 2023, dated Aug. 7, 2023, 9 pgs.
Chen, Shifeng; Notice of Allowance for U.S. Appl. No. 29/895,784, filed Jun. 26, 2023, dated Aug. 10, 2023, 9 pgs.
Chen, Shifeng; Notice of Allowance for Design U.S. Appl. No. 29/753,406, filed Sep. 30, 2020, dated Jul. 14, 2023, 11 pgs.
Chen, Shifeng; Notice of Allowance for Design U.S. Appl. No. 29/895,793, filed Jun. 26, 2023, dated Aug. 11, 2023, 9 pgs.

* cited by examiner

THREE-PACK BEVERAGE BOX

CROSS-REFERENCE TO RELATED APPLICATIONS

This application is a continuation of prior U.S. application Ser. No. 16/903,451, filed Jun. 17, 2020, which is incorporated in its entirety by reference.

TECHNICAL FIELD

This disclosure relates to packaging. Specifically, this disclosure relates to packaging for beverage containers.

BACKGROUND

Beverage distribution often involves the shipment of fragile or breakable vessels, such as glass bottles. Packaging utilized for beverage distribution often divides and individually protects the bottles in separate cells. These separate cells are frequently defined by additional cardboard inserts that much be manufactured as separate components from the box, assembled, and then placed into the box. This assembly process involves numerous time-consuming separate steps when performed at the volume of mass production.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a blank comprising a front panel; a wing portion coupled to the front panel by a wing hinge, the wing portion comprising an attachment panel disposed opposite from the wing hinge, the attachment panel configured to couple to the front panel to at least partially form a cavity between the front panel and the wing portion; a lower telescoping panel coupled to the front panel by a lower telescoping hinge; and an upper telescoping panel coupled to the lower telescoping panel by an upper telescoping hinge, the upper telescoping panel and the lower telescoping panel configured to fold into the cavity in a closed configuration to at least partially enclose the cavity.

Also disclosed is a box comprising a front panel; a first side panel coupled to the front panel by a first wing hinge; a second side panel coupled to the front panel by a second wing hinge; a rear panel coupled to the first side panel by a first side hinge and the second side panel by a second wing hinge, the front panel, the first side panel, the second side panel, and the rear panel at least partially defining a cavity, the front panel, the first side panel, the second side panel, and the rear panel defining an opening to the cavity; a lower telescoping panel coupled to the front panel by a lower telescoping hinge; and an upper telescoping panel coupled to the upper telescoping panel by an upper telescoping hinge, the upper telescoping panel and the lower telescoping panel being disposed external to the cavity in an open configuration, the upper telescoping panel and the lower telescoping panel being disposed within the cavity in a closed configuration.

Also disclosed is a method of forming a box from a blank, the method comprising folding a first wing portion of the blank about a first side hinge; coupling a first attachment panel of the first wing portion to a front panel of the blank; folding a second wing portion of the blank about a second side hinge; and coupling a second attachment panel of the second wing portion to the front panel.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
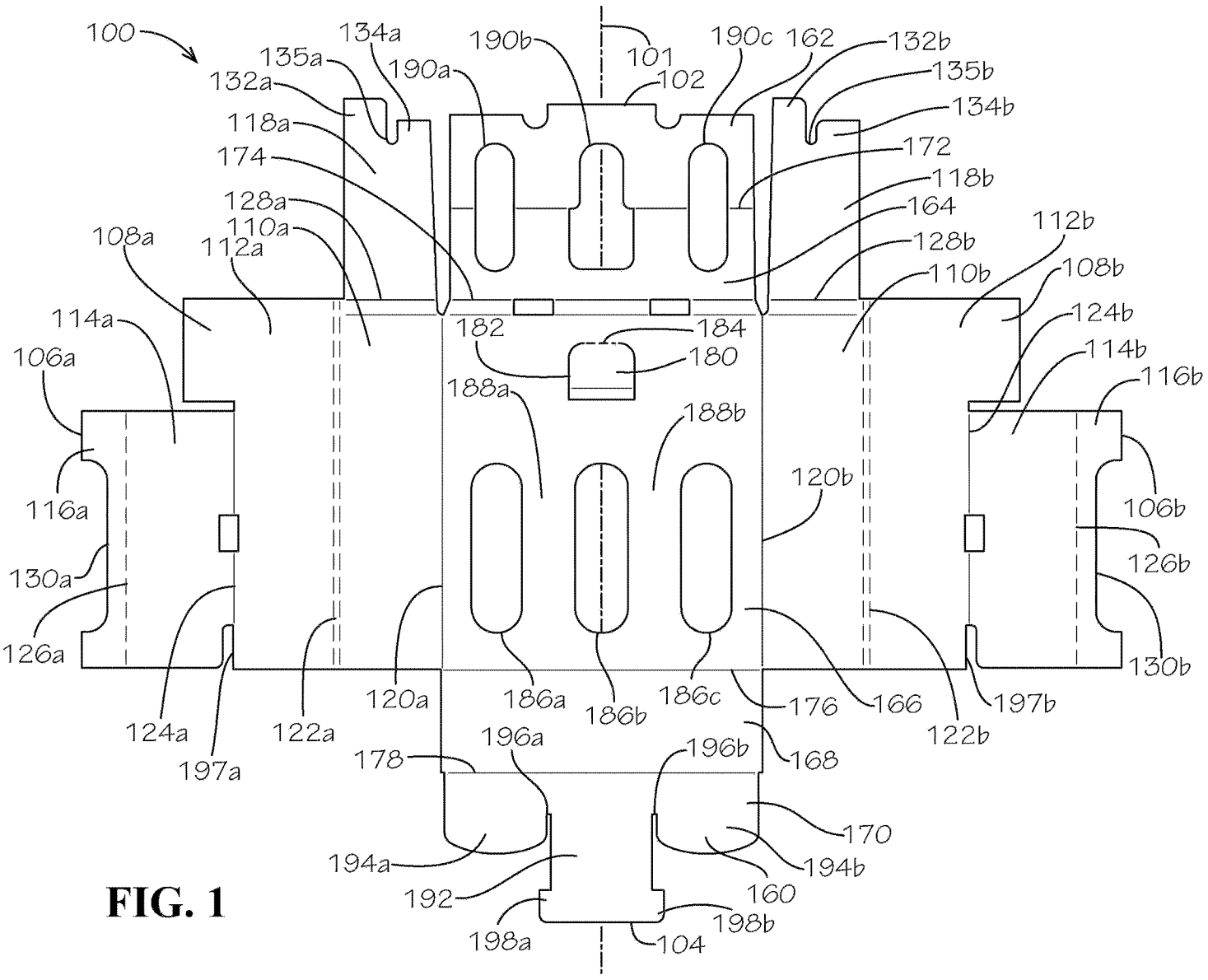
FIG. 1 is a top view of a blank in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a blank and associated methods, systems, devices, and various apparatus. The blank can comprise a first wing portion, a middle wing portion, and a second wing portion. It would be understood by one of skill in the art that the disclosed blank is described in but a few exemplary aspects among many. No particular terminology or description should be considered limiting on the disclosure or the scope of any claims issuing therefrom.

Figure 2:
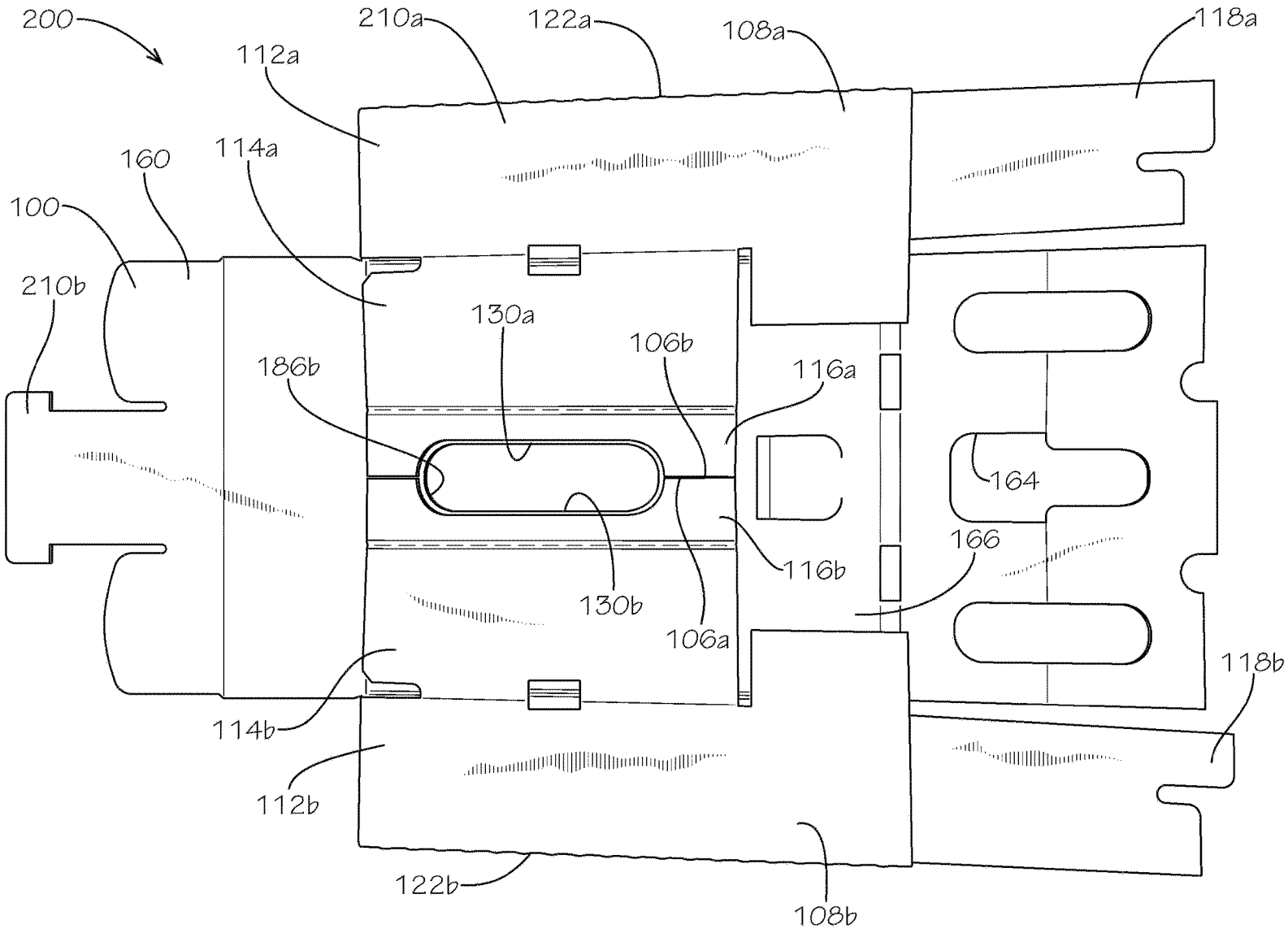
FIG. 2 is a rear view of a box, assembled from the blank of FIG. 1, in a collapsed configuration in accordance with another aspect of the present disclosure.
Figure 3:
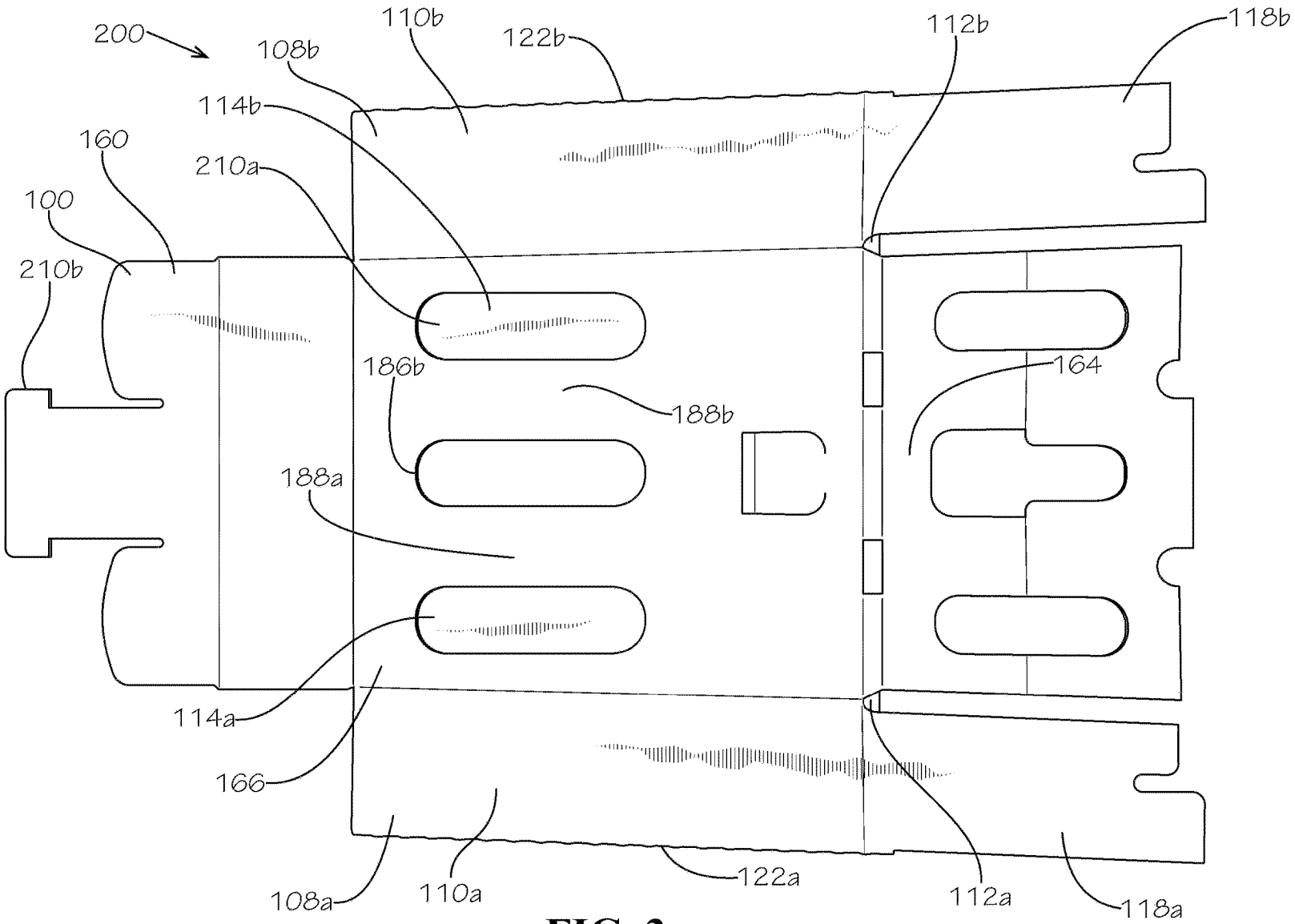
FIG. 3 is a front view of the box of FIG. 2 in the collapsed configuration.

FIG. 1 is a top view of a blank 100, which can be assembled into a box 200, as shown in a collapsed configuration in FIGS. 2 and 3 and in an erected configuration in FIGS. 6-13. The blank 100 can define a top end 102 and a bottom end 104. The bottom end 104 can be disposed opposite from the top end 102. The blank 100 can define a center axis 101, which can extend from the top end 102 to the bottom end 104 and can bisect the blank 100. The blank 100 can also define a first side 106*a* and a second side 106*b*. The first side 106*a* can be disposed opposite from the second side 106*b*.

The blank 100 can comprise a first wing portion 108*a*, a middle portion 160, and a second wing portion 108*b*. The first wing portion 108*a* can define the first side 106*a*, and the second wing portion 108*b* can define the second side 106*b*. The middle portion 160 can be positioned between the first wing portion 108*a* and the second wing portion 108*b*.

From the middle portion 160 to the first side 106*a*, the first wing portion 108*a* can comprise a first side panel 110*a*, a first rear panel 112*a*, a first partition panel 114*a*, and a first attachment panel 116*a*. The first wing portion 108*a* can also comprise a first top flap panel 118*a* coupled to the first side panel 110*a* and extending upwards towards the top end 102. A first wing hinge 120*a* can couple the first wing portion 108*a* to the middle portion 160. Specifically, the first wing hinge 120*a* can couple the first side panel 110*a* to a front panel 166 of the middle portion 160. A first side hinge 122*a* can couple the first rear panel 112*a* to the first side panel 110*a*. A first rear hinge 124*a* can couple the first partition panel 114*a* to the first rear panel 112*a*. A first partition hinge 126*a* can couple the first attachment panel 116*a* to the first partition panel 114*a*. The attachment panel 116*a* can define a clearance cut 130*a* at the first side 106*a*. A first top flap hinge 128*a* can couple the first top flap panel 118*a* to the first side panel 110*a*.

From the middle portion 160 to the second side 106*b*, the second wing portion 108*b* can comprise a second side panel 110*b*, a second rear panel 112*b*, a second partition panel 114*b*, and a second attachment panel 116*b*. The second side portion can also comprise a second top flap panel 118*b* coupled to the second side panel 110*b* and extending upwards towards the top end 102. A second wing hinge 120*b* can couple the second wing portion 108*b* to the middle portion 160. Specifically, the second wing hinge 120*b* can couple the second side panel 110*b* to the front panel 166 of the middle portion 160. A second side hinge 122*b* can couple the second rear panel 112*b* to the second side panel 110*b*. A second rear hinge 124*b* can couple the second partition panel 114*b* to the second rear panel 112*b*. A second partition hinge 126*b* can couple the second attachment panel 116*b* to the second partition panel 114*b*. The attachment panel 116*b* can define a clearance cut 130*b* at the second side 106*b*. A second top flap hinge 128*b* can couple the second top flap panel 118*b* to the second side panel 110*b*.

Hinges 120*a,b*,122*a,b*,124*a,b*,126*a,b* can extend in a top-to-bottom direction, substantially parallel to the center axis 101. The top flap hinges 128*a,b* can extend in a side-to-side direction, substantially perpendicular to the center axis 101.

With the exception of differences between the first top flap panel 118*a* and the second top flap panel 118*b*, the first wing portion 108*a* can be a reflection of the second wing portion 108*b* across the center axis 101. Each top flap panel 118*a,b* can respectively define a major locking tab 132*a,b* and a minor locking tab 134*a,b* with a top locking notch 135*a,b* defined between them. The locking tabs 132*a,b*,134*a,b* can extend upwards from the respective top flap panel 118*a,b* and towards the top end 102. The major locking tabs 132*a,b* can be longer than the minor locking tabs 134*a,b* in the axial direction. Instead of being reflected over the center axis 101, in the present axis, each major locking tab 132*a,b* can be positioned closer to the first side 106*a* on the respective top flap panel 118*a,b*, and each minor locking tab 134*a,b* can be positioned closer to the second side 106*b* on the respective top flap panel 118*a,b*. In other aspects, this configuration can be reversed left-to-right with respect to the present viewing perspective.

From the top end 102 to the bottom end 104, the middle portion 160 can comprise an upper telescoping panel 162, a lower telescoping panel 164, the front panel 166, a bottom panel 168, and a rear locking panel 170. The upper telescoping panel 162 can be coupled to the lower telescoping panel 164 by an upper telescoping hinge 172. The lower telescoping panel 164 can be coupled to the front panel 166 by a lower telescoping hinge 174. The front panel 166 can be coupled to the bottom panel 168 by a bottom hinge 176. The bottom panel 168 can be coupled to the rear locking panel 170 by a side hinge 178.

The rear locking panel 170 can define a locking tongue 192 and a pair of passage tabs 194*a,b* positioned opposite from the side hinge 178. In the present aspect, the locking tongue 192 can define the bottom end 104. The locking tongue 192 can be centered between the passage tabs 194*a,b*.

The rear locking panel 170 can define a pair of clearance slots 196*a,b*, respectively positioned between the locking tongue 192 and the passage tabs 194*a,b*. The clearance slots 196*a,b* can extend into the rear locking panel 170, away from the bottom end 104 and towards the side hinge 178. The clearance slots 196*a,b* can be configured to engage with a pair of wing clearance slots 197*a,b*, respectively defined by the wing portions 108*a,b* between the respective rear panels 112*a,b* and partition panels 114*a,b*. Adjacent to the bottom end 104, the locking tongue 192 can define a pair of locking tabs 198*a,b*. Locking tab 198*a* can extend towards the first side 106*a*, and locking tab 198*b* can extend towards the second side 106*b*.

The front panel 166 can define a cutout flap 180 positioned on the front panel 166 towards the top end 102. The cutout flap 180 can be coupled to the surrounding portions of the front panel 166 by a cutout flap hinge 184, which can be positioned nearest the top end 102. The remaining sides of the cutout flap 180 can be defined by a cutout flap cut 182, which can extend completely through the front panel 166 in the present aspect. In other aspects, the cutout flap cut 182 can be scored or perforated. Accordingly, the cutout flap 180 can fold relative to the front panel 166 about the cutout flap hinge 184.

The front panel 166 can define viewing ports 186*a,b,c*. In the present aspect, the front panel 166 defines three viewing ports 186*a,b,c*; however, in other aspects, the front panel 166 can define greater or fewer than three viewing ports. Each of the viewing ports 186*a,b,c* can extend through the front panel 166. The viewing ports 186*a,b,c* can be shaped as geometric stadiums (also known as obrounds or discorectangles), which can be elongated in a direction extending parallel to the center axis 101. In other aspects, the viewing ports 186*a,b,c* can define a different shape, such as a rectangular, elliptical, or circular shape, for example and without limitation. Two dividing portions 188*a,b* of the front panel 166 can be defined between adjacent viewing ports 186*a,b,c*.

Figure 10:
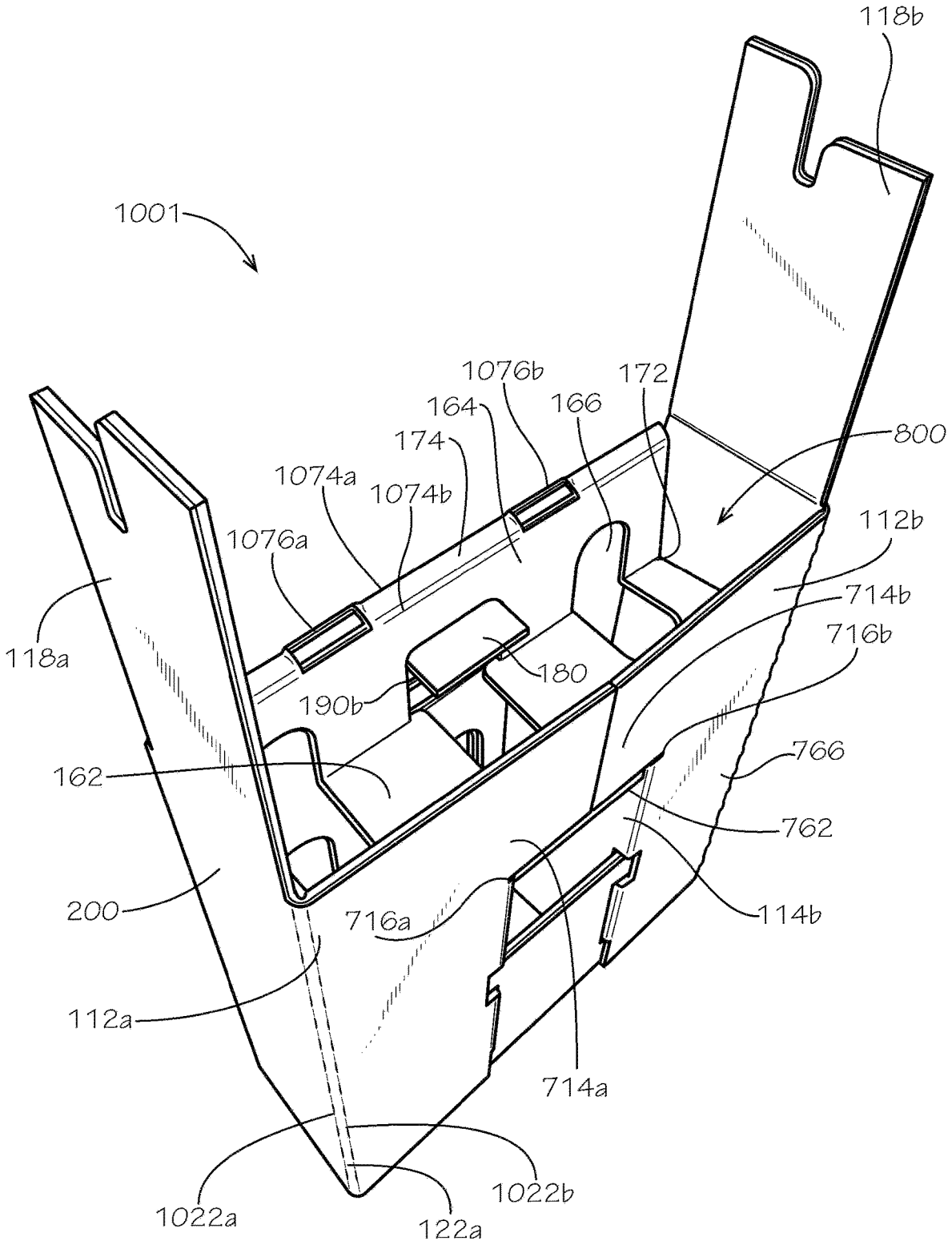
FIG. 10 is top rear perspective view of the box of FIG. 2 demonstrating a third step in closing the box.

The upper telescoping panel 162 and the lower telescoping panel 164 can together define three clearance slots 190*a,b,c*, which can extend across the upper telescoping hinge 172. The clearance slots 190*a,b,c* can respectively align with the viewing ports 186*a,b,c*. Clearance slots 190*a,c* can define a geometric stadium shape, and a portion of clearance slot 190*b* near the top end 102 can also define half of a geometric stadium shape. A portion of clearance slot 190*b* closer to the bottom end 104 can be widened to provide clearance for the cutout flap 180 to fold through clearance slot 190*b*, as shown in FIG. 10.

FIG. 2 is a rear view of a box 200, shown in the collapsed configuration, formed from the blank 100 of FIG. 1; and FIG. 3 is a front view of the box 200 of FIG. 2, shown in the collapsed configuration. To form the box 200 in the collapsed configuration from the blank 100, the wing portions 108*a,b* can be folded about the respective side hinges 122*a,b*, and the respective attachment panels 116*a,b* can be coupled to the front panel 166, through any suitable means, including, for example and without limitation, an adhesive or a mechanical means, such as stabling, welding, buttoning, etc. Specifically, the first attachment panel 116*a* can be coupled to dividing portion 188*a* (shown in FIG. 3), and the second attachment panel 116*b* can be coupled to dividing portion 188*b* (shown in FIG. 3). The attachment panels 116*a,b* can be positioned together such that the first side 106*a* is positioned adjacent to the second side 106*b*. The clearance cutouts 130*a,b* can be configured such that, when aligned, they together form a shape complementary to viewing port 186*b* so as not to obstruct viewing port 186*b*.

In the collapsed configuration, the box 200 can comprise two layers 210*a,b*. A first layer 210*a* (best shown in FIG. 2) can comprise the rear panels 112*a,b*, the partition panels 114*a,b*, and the attachment panels 116*a,b*, which can all be substantially aligned. A second layer 210*b* (best shown in FIG. 3) can comprise the middle portion 160, the top flap panels 118*a,b*, and the side panels 110*a,b* (shown in FIG. 3), which can all be substantially aligned. Each layer 210*a,b* can be substantially planar, and the layers 210*a,b* can be positioned adjacent with one another. In some aspects, the layers 210*a,b* can be substantially parallel to one another, with the exception of slight deformations caused by hinges and other insubstantial contours. At least some portions of the layers 210*a,b* can be positioned in facing engagement with one another in the collapsed configuration. For example and without limitation, in some aspects, the partition panels 114*a,b* can be positioned in facing engagement with the front panel 166. In some aspects, the rear panels 112*a,b* can be positioned in facing engagement with the side panels 110*a,b* and/or the front panel 166. In some aspects, the rear panels 112*a,b* can be positioned in facing engagement with the lower telescoping panel 164 and the top flap panels 118*a,b*. In some aspects, internal stresses within the materials, such as around the side hinges 122*a,b*, or memory of the material can space adjacent panels slightly apart from one another in the collapsed configuration.

Figure 4:
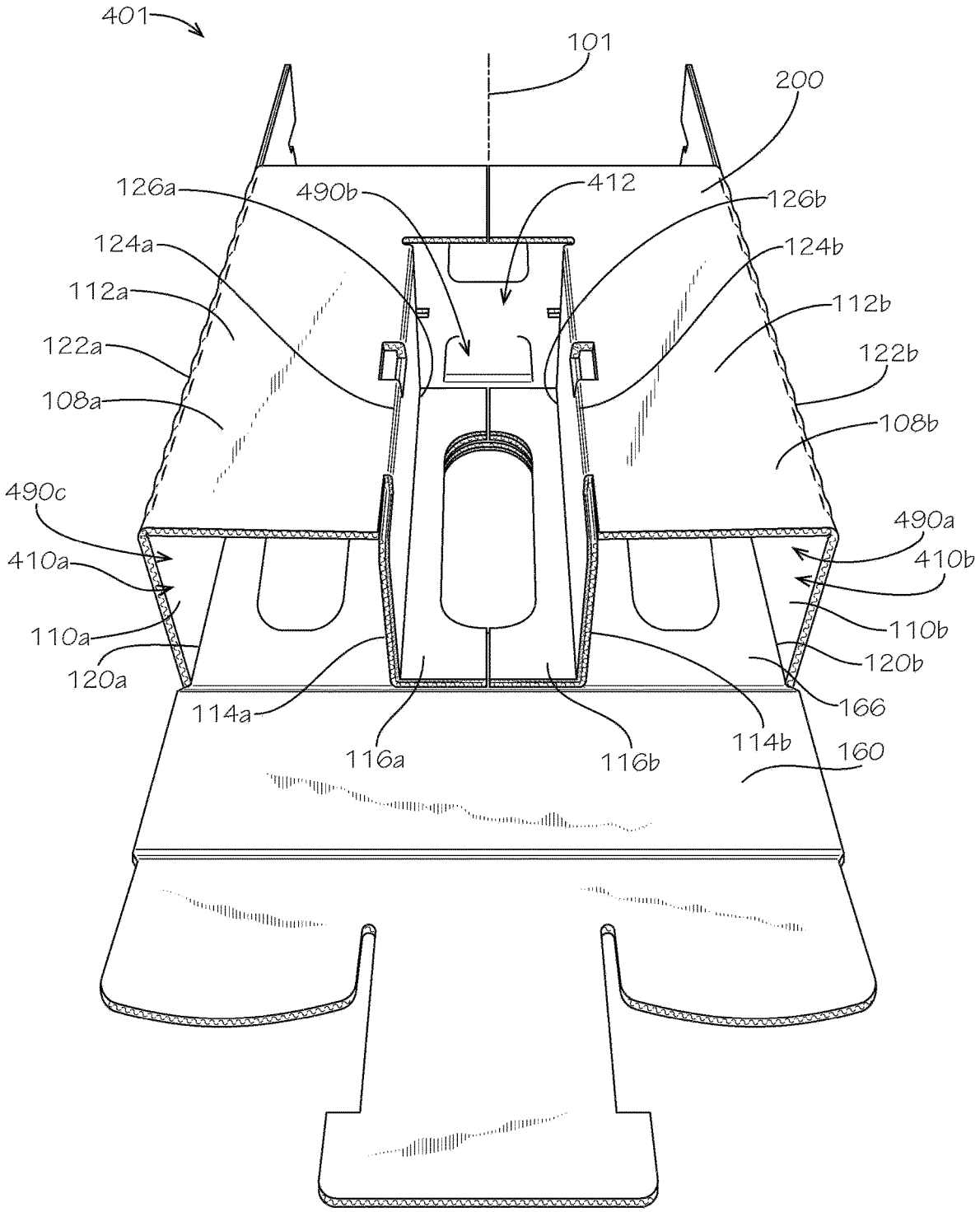
FIG. 4 is a bottom perspective view of the box of FIG. 2 demonstrating a first step in erecting the box.
Figure 5:
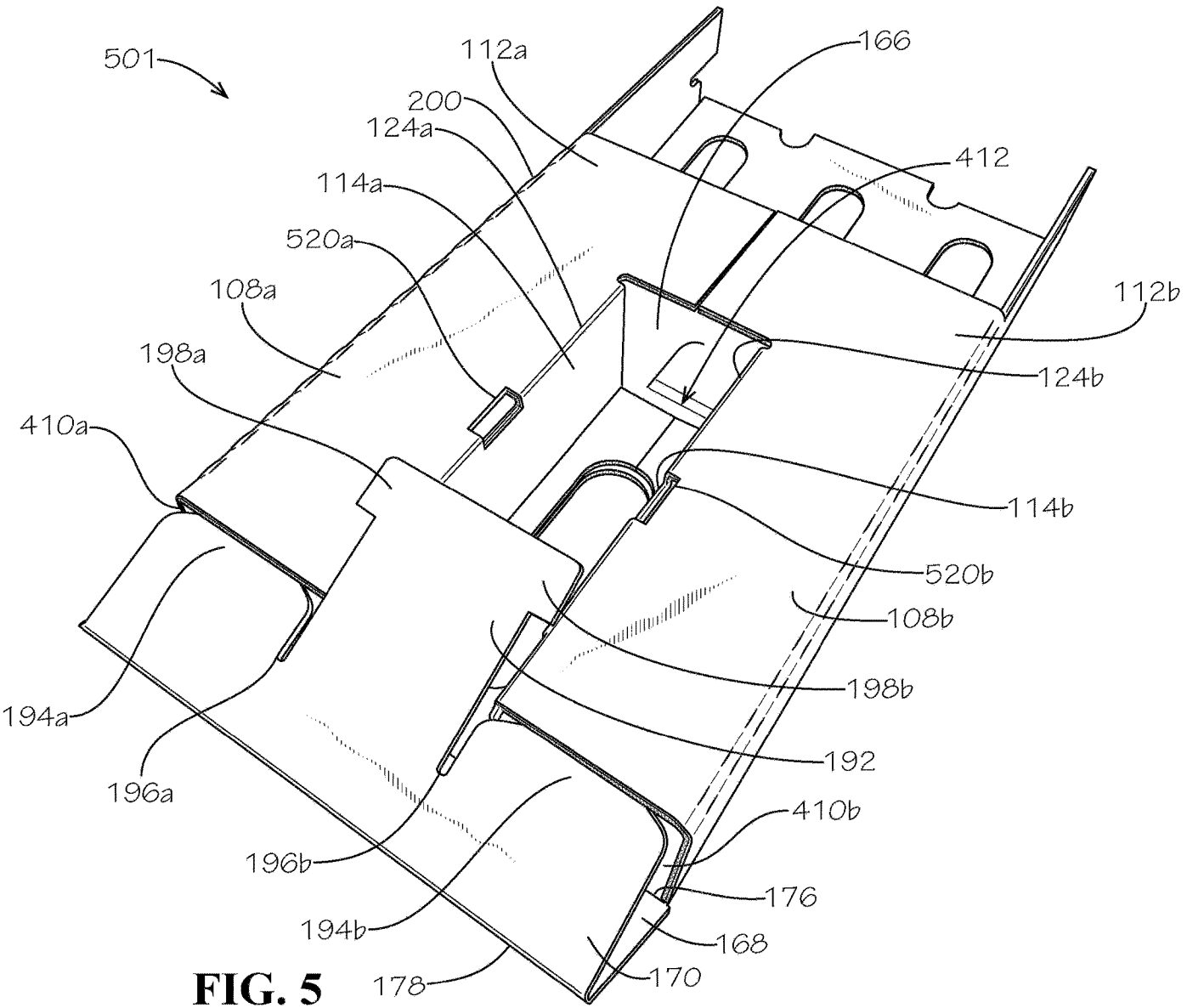
FIG. 5 is a perspective view of the box of FIG. 2 showing a second step in the erection of the box.
Figure 6:
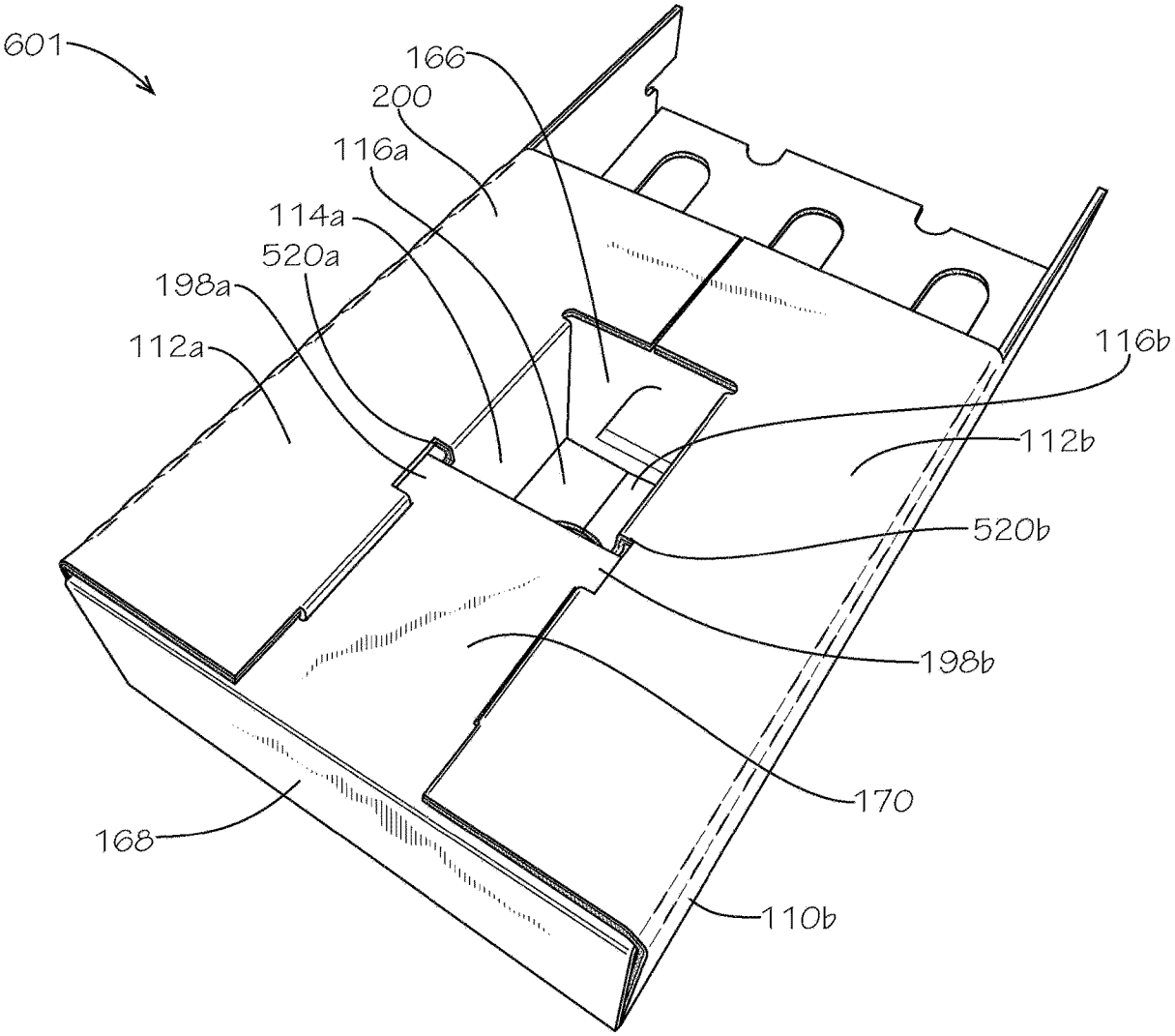
FIG. 6 is a perspective view of the box of FIG. 2 showing a third step in the erection of the box, placing the box in an erected configuration.

FIGS. 4-6 demonstrate the erection of the box 200 of FIG. 2 from the collapsed configuration show in FIGS. 2-3 to the erected configuration shown in FIGS. 6-13. FIG. 4 is a bottom perspective view of the box 200 of FIG. 2 showing a first step 401 of the erection of the box 200. FIG. 5 is a perspective view of the box 200 of FIG. 2 showing a second step 501 of the erection of the box 200. FIG. 6 is a perspective view of the box 200 of FIG. 2 showing a third step 601 of the erection of the box 200, which completes the process and places the box 200 in the erected configuration.

Referring to FIG. 4, in step 401, the wing portions 108*a,b* can be folded again to erect the box 200 from the collapsed configuration shown in FIGS. 2 and 3. For example and without limitation, a user can press the side hinges 122*a,b* inward towards the center axis 101, which can result in the respective adjacent panels 110*a,b*,112*a,b*,114*a,b*,116*a,b* folding about the wing hinges 120*a,b*, the side hinges 122*a,b*, the rear hinges 124*a,b*, and the partition hinges 126*a,b*. In another exemplary example, a user can pull upwards (relative to the present viewing angle) on the side panels 110*a,b* while holding the middle portion 160 down to erect the box 200.

The wing portions 108*a,b* can be folded until the rear panels 112*a,b*, the front panel 166, and the attachment panels 116*a,b* are substantially perpendicular to the side panels 110*a,b* and the partition panels 114*a,b*. The front panel 166, the side panels 110*a,b*, the rear panels 112*a,b*, and the partition panels 114*a,b* can respectively define a pair of passages 410*a,b*. The passages 410*a,b* can each define a substantially rectangular or square cross-section; however, in other aspects, the passages 410*a,b* can define a different cross-sectional shape, such as trapezoidal for example and without limitation.

The partition panels 114*a,b*, the front panel 166, and the attachment panels 116*a,b* can additionally define a channel 412 between the passages 410*a,b*. The channel 412 can define a substantially rectangular or square cross-section; however, in other aspects, the channel 412 can define a different cross-sectional shape, such as trapezoidal for example and without limitation. The passages 410*a,b* and channel 412 can form cells for holding containers, such as containers 1100*a,b,c* shown in FIGS. 11 and 12. The channel 412 and the passages 410*a,b* can together define a plurality of cells 490*a,b,c* within the box 200, as further described below with respect to FIG. 11.

Referring to FIG. 5, each wing portion 108*a,b* can respectively define a locking hole 520*a,b*. In the present aspect, the locking holes 520*a,b* can respectively extend through the rear panels 112*a,b* and the partition panels 114*a,b*. In other aspects, the locking holes 520*a,b* may only extend through either the partition panels 114*a,b* or the rear panels 112*a,b*. In the present aspect, the rear hinges 124*a,b* can intersect the respective locking holes 520*a,b*.

As shown in step 501, the bottom panel 168 can be folded relative to the front panel 166 about the bottom hinge 176, and the rear locking panel 170 can be folded relative to the bottom panel 168 about the side hinge 178 to enclose a bottom end of the passages 410*a,b* and the channel 412. As the box 200 is erected, the locking tongue 192 can be folded upwards towards the locking holes 520*a,b*, and the passage tabs 194*a,b* can be deflected slightly downwards and inserted into the respective passages 410*a,b*. As the bottom panel 168 is folded towards and positioned substantially perpendicular to the front panel 166 about the bottom hinge 176, the clearance slots 196*a,b* can engage with the wing clearance slots 197*a,b* (shown in FIG. 1).

As shown in FIG. 6, in step 601, the locking tabs 198*a,b* can be inserted into the respective locking holes 520*a,b* to secure the box 200 in the erected configuration. In the erected configuration, the bottom panel 168 can be positioned substantially perpendicular to the front panel 166, the side panels 110*a,b* (first side panel 110*a* shown in FIG. 1), the rear panels 112*a,b*, the partition panels 114*a,b* (second partition panel 114*b* shown in FIG. 1), the attachment panels 116*a,b*, and the rear locking panel 170. The rear locking panel 170 can be positioned substantially parallel with the front panel 166, the attachment panels 116*a,b*, and the rear panels 112*a,b*. The rear locking panel 170 can be substantially perpendicular to the side panels 110*a,b* and the partition panels 114*a,b*.

Figure 7:
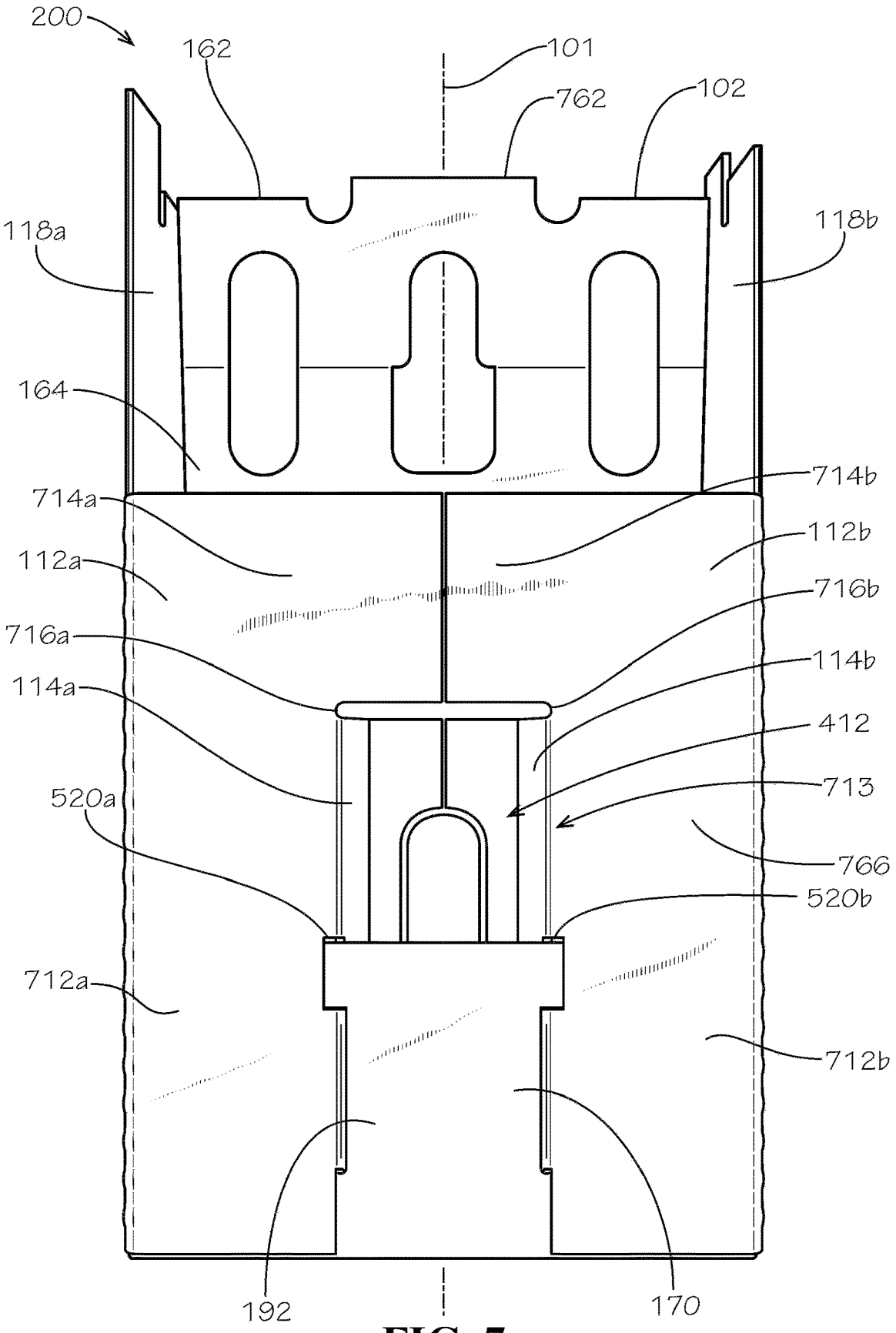
FIG. 7 is a rear view of the box of FIG. 2 in the erected configuration, with an upper telescoping panel, a lower telescoping panel, and a pair of top flap panels of the box shown in an open configuration.

FIG. 7 is a rear view of the box 200 in the erected configuration, with the upper telescoping panel 162, the lower telescoping panel 164, and the top flap panels 118*a,b* shown in an open configuration. In the open configuration, the upper telescoping panel 162 and the lower telescoping panel 164 can be substantially coplanar with the front panel 166 (shown in FIG. 6), and the top flap panels 118*a,b* can be substantially coplanar with the side panels 110*a,b* (shown in FIG. 1). In other aspects, the upper telescoping panel 162, the lower telescoping panel 164, and/or the side panels 110*a,b* can be folded outwards and away from an opening 802 (shown in FIG. 8) of the box 200 in the open configuration.

Figure 13:
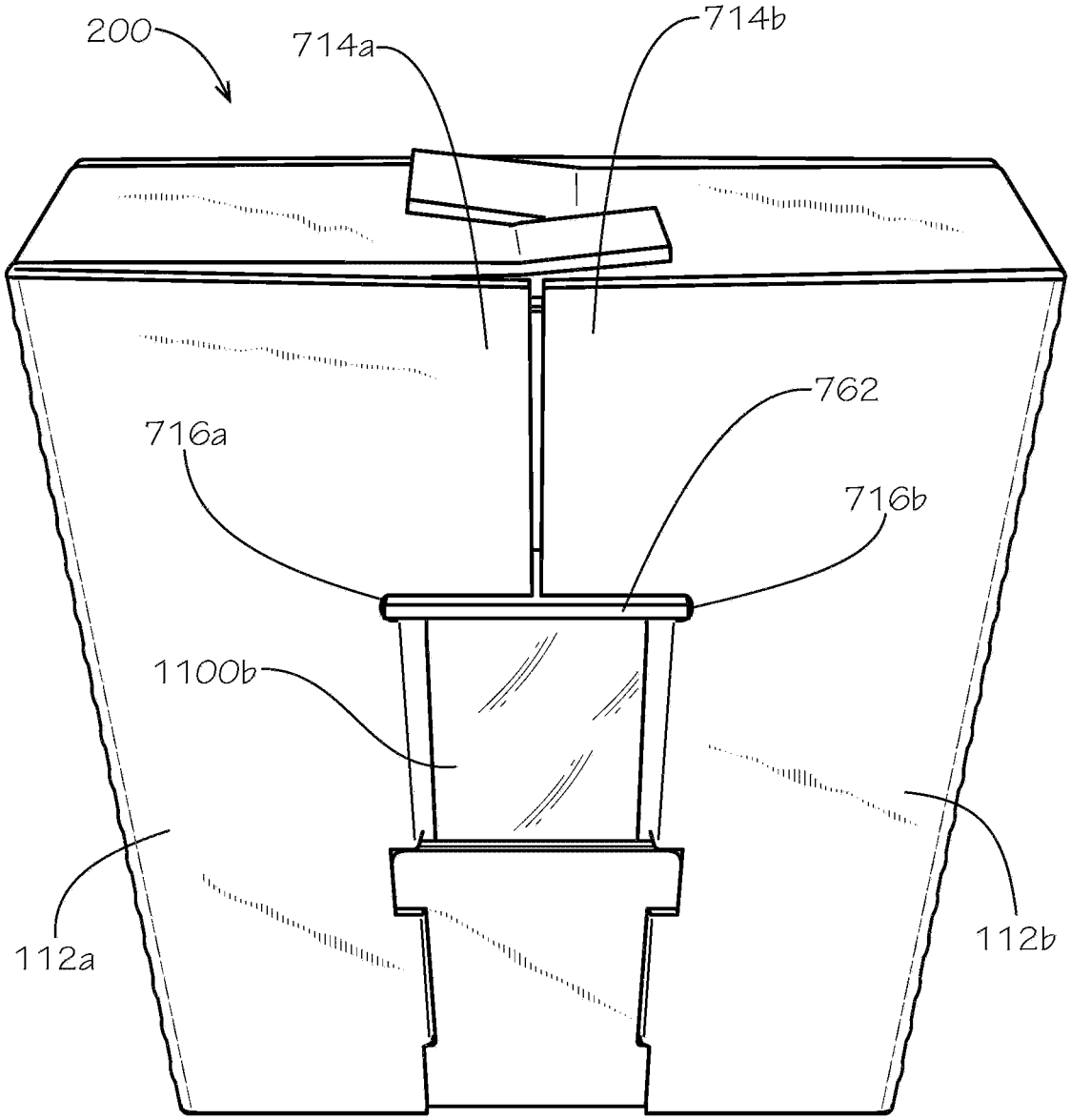
FIG. 13 is a rear perspective view of the box of FIG. 2 in the erected configuration with the upper telescoping panel, the lower telescoping panel, and the pair of top flap panels in the closed configuration.

In the erected configuration, the rear panels 112*a,b* and the rear locking panel 170 can define a rear panel 766 of the box 200. The rear panels 112*a,b* can each respectively define a main portion 712*a,b* positioned between the partition panels 114*a,b* and the side panels 110*a,b* (shown in FIG. 1), and an inner tab portion 714*a,b* extending inwards from the respective main portion 712*a,b* towards the center axis 101. In the present aspect, the inner tab portions 714*a,b* can meet at the center axis 101. Each rear panel 112*a,b* can define a notch 716*a,b* between the respective main portion 712*a,b* and inner tab portion 714*a,b*. The upper telescoping panel 162 can define a locking tab 762 at the top end 102, and the locking tab 762 can engage the notches 716*a,b* and inner tab portions 714*a,b* when the upper telescoping panel 162 and the lower telescoping panel 164 are in the closed configuration, as shown in FIG. 13.

In the present aspect, the rear locking panel 170 and the rear panels 112*a,b* can define a rear viewing port 713 into the channel 412. In other aspects, the channel 412 can be fully enclosed from the rear panel 766. For example and without limitation, the locking tongue 192 can be longer so that the rear locking panel 170 can cover the channel 412. In some aspects, the locking holes 520*a,b* can be placed closer to the inner tab portions 714*a,b*, and a locking slot can be defined extending from notch 716*a* to notch 716*b* between the inner tab portions 714*a,b* and the rear locking panel 170.

Figure 11:
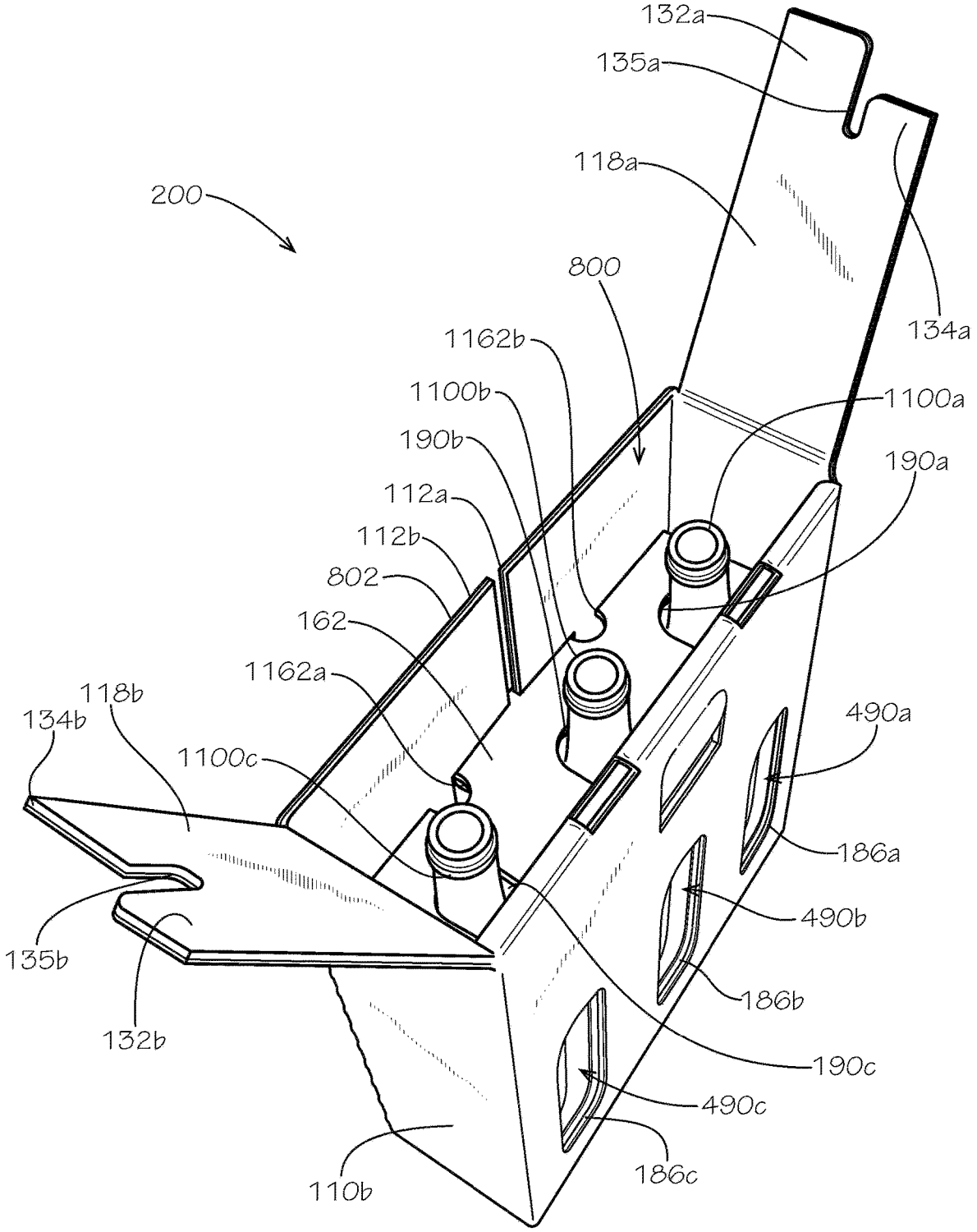
FIG. 11 is a top front perspective view of the box of FIG. 2 holding three containers.
Figure 12:
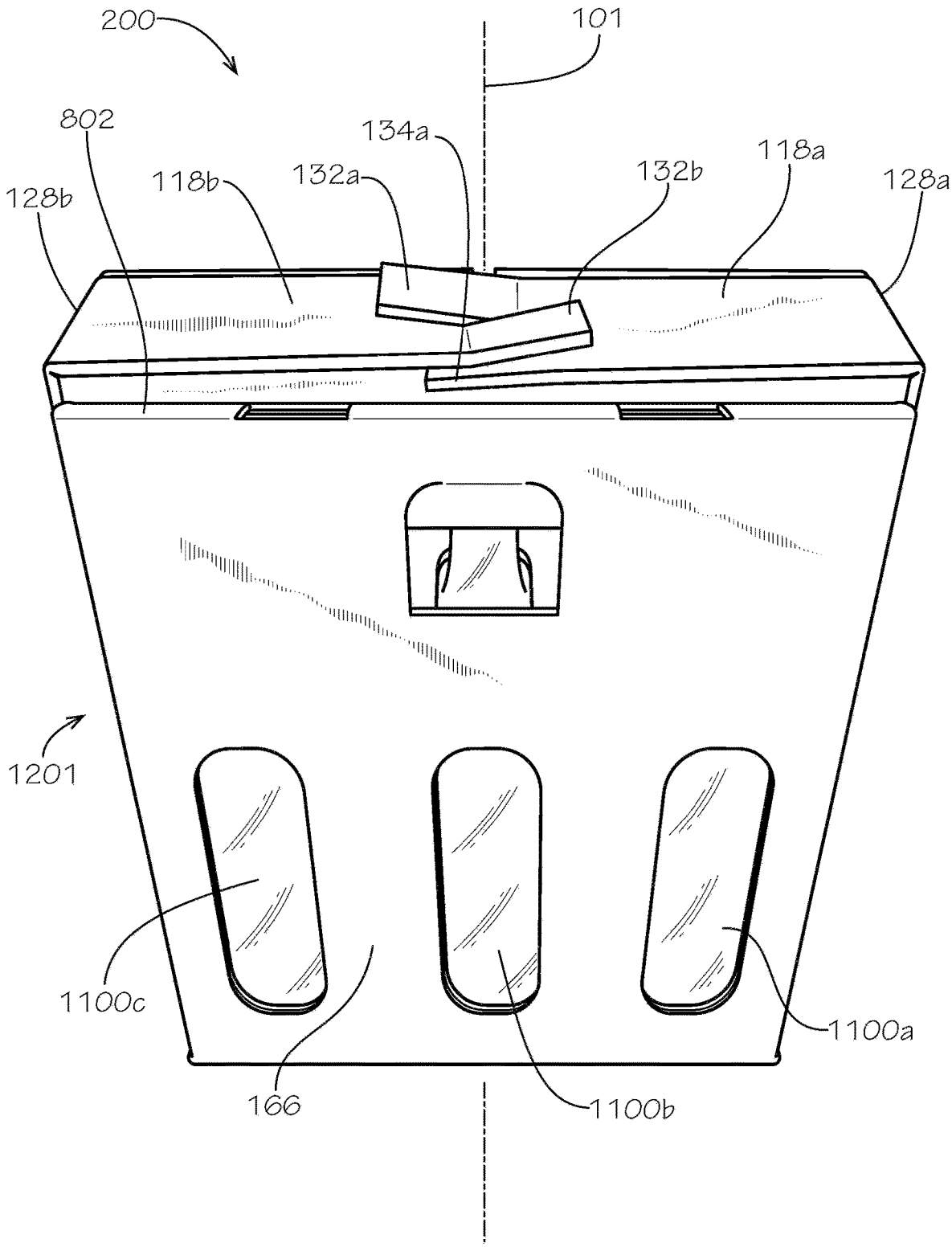
FIG. 12 is a front perspective view of the box of FIG. 2 in the erected configuration with the upper telescoping panel, the lower telescoping panel, and the pair of top flap panels in the closed configuration.

FIGS. 8-12 show the steps for closing the box 200 of FIG. 2 by reconfiguring the top flap panels 118*a,b*, the upper telescoping panel 162, and the lower telescoping panel 164 from the open configuration to a closed configuration, shown in FIG. 12.

Figure 8:
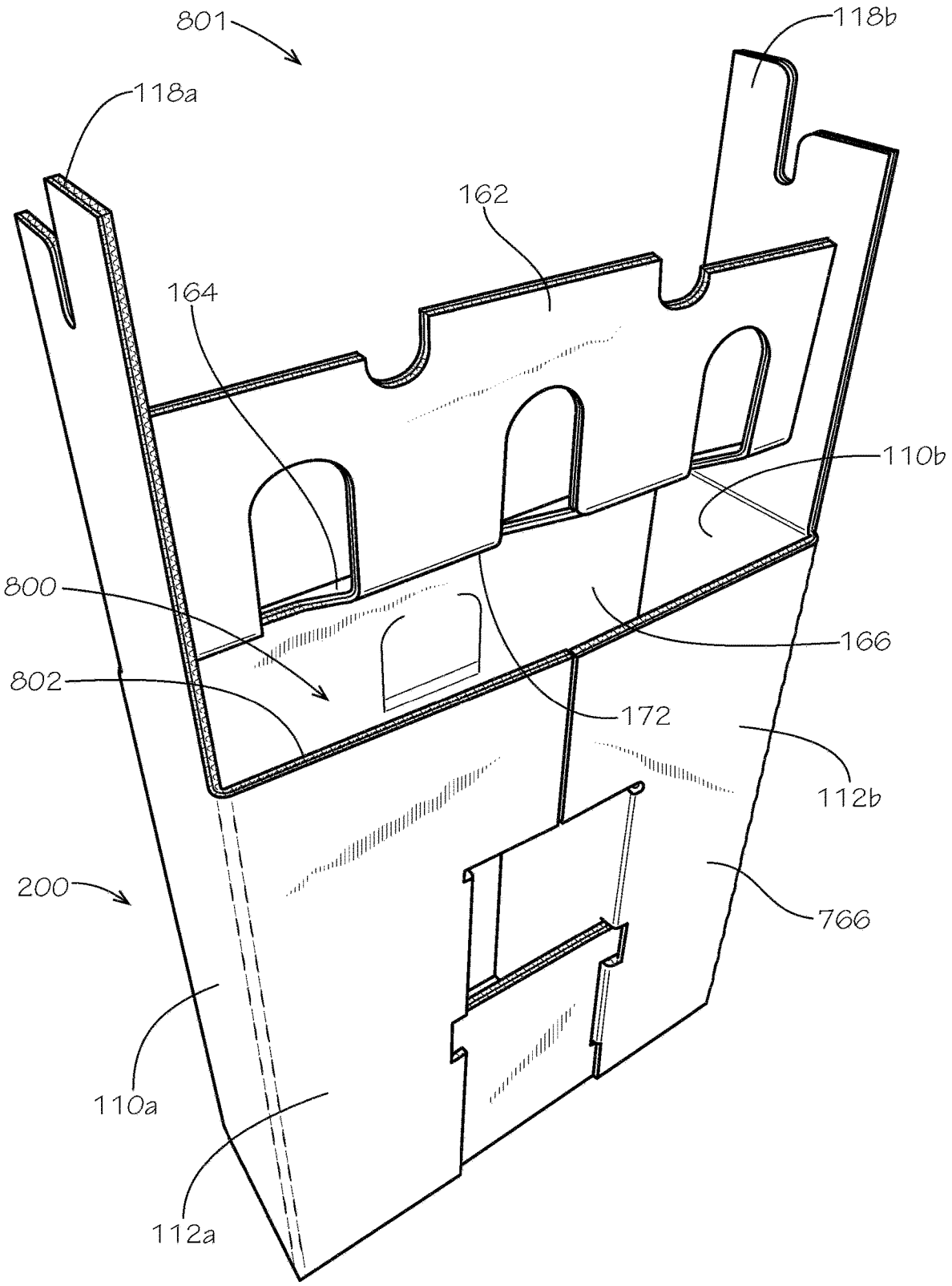
FIG. 8 is a perspective rear view of the box of FIG. 2 with the upper telescoping panel and the lower telescoping panel demonstrating a first step in closing the box.

FIG. 8 is a perspective rear view of the box 200 of FIG. 2 with the upper telescoping panel 162 and the lower telescoping panel 164 demonstrating a first step 801 in closing the box 200. The front panel 166, the side panels 110*a,b*, and the rear panels 112*a,b* can define the opening 802 to a cavity 800 defined by the box 200. In step 801, the lower telescoping panel 164 can be folded downwards and towards the opening 802 about the lower telescoping hinge 174 (shown in FIG. 9). The upper telescoping panel 162 can be folded upwards and away from the opening 802 about the upper telescoping hinge 172.

Figure 9:
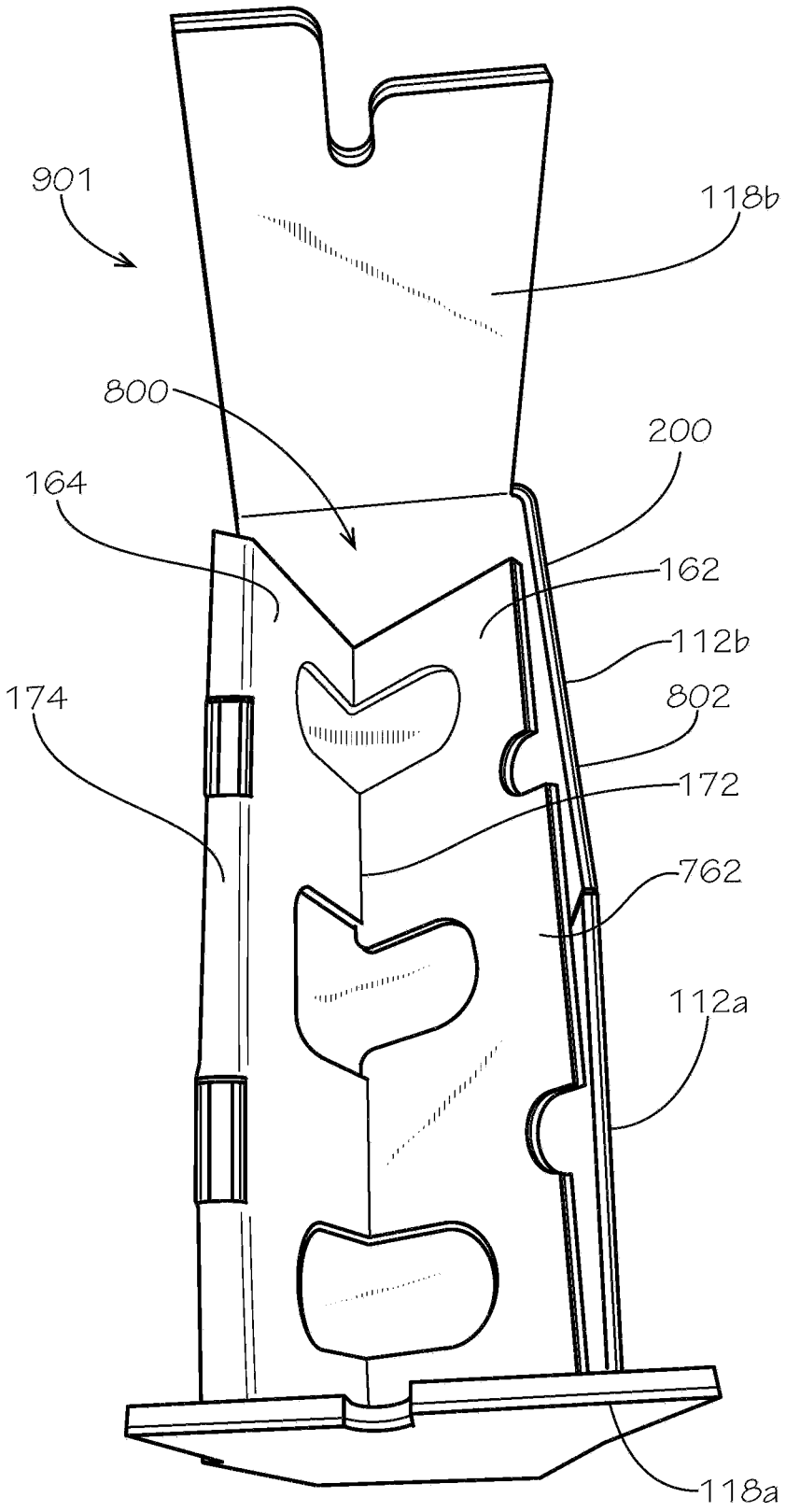
FIG. 9 is a top side perspective view of the box of FIG. 2 demonstrating a second step in closing the box.

FIG. 9 is a top side perspective view of the box 200 of FIG. 2, showing a second step 901 in closing the box 200. In step 901, the upper telescoping panel 162 and the lower telescoping panel 164 can be folded through the opening 802 and into the cavity 800 about the lower telescoping hinge 174. The lower telescoping panel 164 can extend downwards from the lower telescoping hinge 174, and the upper telescoping panel 162 can extend upwards from the upper telescoping hinge 172 so that the locking tab 762 points upwards towards the opening 802.

FIG. 10 is a top rear perspective view of the box 200 showing a third step 1001 in closing the box 200. As shown, the upper telescoping panel 162 and the lower telescoping panel 164 can be in the closed position while the top flap panels 118*a,b* can remain in the open position. In the closed position, the lower telescoping panel 164 and the upper telescoping panel 162 can be positioned completely within the cavity 800. In the closed position, the lower telescoping panel 164 can be folded 180-degrees about the lower telescoping hinge 174 until the lower telescoping panel 164 is positioned in facing contact with and is substantially parallel with the front panel 166. The upper telescoping panel 162 can be folded about the upper telescoping hinge 172 until the upper telescoping panel 162 extends from the front panel 166 to the rear panel 766. Specifically, the upper telescoping panel 162 can extend from the front panel 166 to the rear panels 112*a,b* in the closed configuration. The locking tab 762 can slip under the inner tab portions 714*a,b* of the rear panels 112*a,b*, and can engage the notches 716*a,b*, as shown here and also in FIG. 13.

In the present aspect, the upper telescoping panel 162 can be substantially perpendicular to the lower telescoping panel 164, the front panel 166, and the rear panels 112*a,b* in the closed configuration. In other aspects, an angle defined between the upper telescoping panel 162 and the lower telescoping panel 164 can be larger or smaller than 90-degrees, and the angle can be acute or obtuse. In some aspects, the upper telescoping panel 162 can rest upon the partition panels 114*a,b* (partition panel 114*a* shown in FIG. 1).

As discussed above with respect to FIG. 1, the blank 100 (shown in FIG. 1) can define numerous hinges 120*a,b*,122*a,b*,124*a,b*,126*a,b*,128*a,b*,172,174,176,178,184. Each of these hinges can be formed from different techniques, such as scoring, perforating, creasing, or any other suitable technique to create a line of weakness in the material of the blank 100. Additionally, each hinge may comprise multiple such lines of weakness. For example and without limitation, the lower telescoping hinge 174 can comprise two bend lines 1074*a,b* formed by creases in the blank 100 material. Additionally, the lower telescoping hinge 174 can define a pair of relief cuts 1076*a,b* to facilitate folding of the lower telescoping hinge 174. Multiple lines of weakness and relief cuts can reduce the stresses in the material where the hinges are folded to form an acute angle or even 180-degrees. As another example, the first side hinge 122*a* can comprise a pair of perforated lines 1022*a,b* to facilitate folding. The second side hinge 122*b* (shown in FIG. 1) can be similarly formed. These examples should not be viewed as limiting, and any hinge 120*a,b*,122*a,b*,124*a,b*,126*a,b*,128*a,b*,172, 174,176,178,184 can be formed from any technique, or combination of techniques.

FIG. 11 is a top front perspective view of the box 200 of FIG. 2 holding three containers 1100*a,b,c* in the cavity 800. In the present aspect, the containers 1100*a,b,c*, can be wine bottles; however, in other aspects, can be different types of containers. For example and without limitation, the containers can be bottles or cans of any alcoholic or non-alcoholic beverages, including beer, liquor, wine, soda, water, juice, or any other beverage. In other aspects, the containers can hold different materials, such as foods, chemicals, perfumes, or any other material. In the present aspect, the box 200 can be ideally suited for holding containers 1100*a,b,c* with elongated and narrowed necks, as commonly found in bottles for liquor, wine, beer, olive oil, vinegar, syrups, and cocktail mixers, for example and without limitation. The containers 1100*a,b,c* can be secured within separate cells 490*a,b,c* of the cavity 800, as shown through the viewing ports 186*a,b,c*. In the closed configuration, the upper telescoping panel 162 can at least partially enclose the cells 490*a,b,c* of the cavity 800, thereby subdividing the cavity 800. Necks of the containers 1100*a,b,c* can be secured within the respective clearance slots 190*a,b,c*, thereby preventing both vertical and lateral motion of the containers 1100*a,b,c*.

To remove the containers 1100*a,b,c* from the box 200, a user can insert a finger into one or both of a pair of finger notches 1162*a,b* defined by the upper telescoping panel 162 and disengage the locking tab 762 (shown in FIG. 7) from the rear panels 112*a,b*, thereby allowing the upper telescoping panel 162 and the lower telescoping panel 164 (shown in FIG. 1) to telescope upwards and out from the opening 802. Alternatively, the user can disengage the locking tabs 198*a,b* (shown in FIG. 5) from the locking holes 520*a,b* (shown in FIG. 5) to open the box 200 from the bottom.

FIG. 12 is a front perspective view of the box 200 in the erected and closed configuration holding containers 1100*a,b,c*. FIG. 13 is a rear perspective view of the box 200 in the erected and closed configuration holding containers 1100*a,b,c* (containers 1100*a,c* shown in FIG. 12).

The transition from FIG. 11 to FIG. 12 demonstrates step 1201 of closing the box 200. In step 1201, the top flap panels 118*a,b* can be folded inwards about the top flap hinges 128*a,b* towards the center axis 101. The major locking tab 132*a,b* for each respective top flap panel 118*a,b* can line up with the minor locking tab 134*a,b* (134*b* shown in FIG. 11) of the opposite top flap panel 118*a,b*. Accordingly, as the top flap panels 118*a,b* meet one another at or near the center axis 101, the minor locking tabs 134*a,b* slide under the respective opposing major tabs 132*a,b*. Once the top flap panels 118*a,b* are positioned substantially perpendicular to the side panels 110*a,b* (first side panel 110*a* shown in FIG. 1) about the top flap hinges 128*a,b*, the top locking notches 135*a,b* (shown in FIG. 11) of the top flap panels 118*a,b* can frictionally engage one another to retain the top flap panels 118*a,b* in the closed configuration.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A box comprising:
a front panel comprising a viewing port;
a wing portion coupled to the front panel comprising and an attachment panel coupled to the front panel;
an upper telescoping panel;
a lower telescoping panel coupled to the front panel and the upper telescoping panel;
a bottom panel coupled to the front panel; and
a rear locking panel coupled to the bottom panel, comprising:
passage tabs; and
a locking tongue positioned between the passage tabs;
wherein in a closed configuration, a cavity is formed and:
the locking tongue engages the wing portion to lock the rear locking panel;
the cavity receives the passage tabs of the rear locking panel; and
the cavity is visible through the viewing port.

2. The box of claim 1, wherein the viewing port of the front panel aligns with a cell of the cavity in the closed configuration.

3. The box of claim 1, wherein the wing portion further comprises a locking hole and the locking tongue of the rear locking panel further comprises a locking tab positioned between the passage tabs.

4. The box of claim 3, wherein the locking tab of the locking tongue on the rear locking panel engages the locking hole of the wing portion in the closed configuration to secure the locking tongue relative to the wing portion.

5. The box of claim 1, wherein the upper telescoping panel comprises a clearance slot aligned with a cell of the cavity to form a rear viewing port of the cell in the closed configuration.

6. The box of claim 5, wherein the cavity in the closed configuration is visible through the viewing port in the front panel and the rear viewing port in the rear locking panel.

7. The box of claim 1, wherein the wing portion further comprises:
a side panel coupled to the front panel;
a rear panel coupled to the side panel; and
a partition panel coupled to the side panel and comprising a locking hole.

8. The box of claim 7, wherein:
the side panel is coupled to the front panel by a wing hinge;
the rear panel is coupled to the side panel by a side hinge;
the partition panel is coupled to the rear panel by a rear hinge; and
the attachment panel is coupled to the partition panel by a partition hinge.

9. The box of claim 8, wherein:
the wing portion further comprises a top flap panel coupled to the side panel by a top flap hinge; and
the top flap hinge is substantially perpendicular to at least one of the wing hinge, the side hinge, the rear hinge, and the partition hinge.

10. A box comprising:
a front panel;
a wing portion coupled to the front panel comprising a locking hole and an attachment panel coupled to the front panel;
an upper telescoping panel;
a lower telescoping panel coupled to the front panel and the upper telescoping panel;
a bottom panel coupled to the front panel; and
a rear locking panel coupled to the bottom panel, comprising:
a rear viewing port;
passage tabs; and
a locking tongue comprising a locking tab positioned between the passage tabs;
wherein in a closed configuration, the box forms a cavity and:
the locking tongue of the rear locking panel engages the locking hole of the wing portion;
the cavity receives the passage tabs of the rear locking panel to couple the locking tongue to the wing portion; and
the cavity is visible through the rear viewing port.

11. The box of claim 10, further comprising a viewing port in the front panel, wherein the viewing port of the front panel and the rear viewing port of the rear locking panel align with a cell of the cavity in the closed configuration.

12. The box of claim 10, wherein the upper telescoping panel comprises a clearance slot aligned with a cell of the cavity to form the rear viewing port of the cell in the closed configuration.

13. The box of claim 12, wherein the cavity in the closed configuration is visible through the rear viewing port in the rear locking panel.

14. The box of claim 10, wherein the wing portion further comprises:
a side panel coupled to the front panel;
a rear panel coupled to the side panel; and
a partition panel coupled to the side panel and comprising the locking hole.

15. The box of claim 14, wherein:
the side panel is coupled to the front panel by a wing hinge;
the rear panel is coupled to the side panel by a side hinge;

the partition panel is coupled to the rear panel by a rear hinge; and the attachment panel is coupled to the partition panel by a partition hinge.

16. The box of claim 15, wherein:

the wing portion further comprises a top flap panel coupled to the side panel by a top flap hinge; and the top flap hinge is substantially perpendicular to at least one of the wing hinge, the side hinge, the rear hinge, and the partition hinge.

17. A blank comprising:

a front panel comprising a viewing port;

a wing portion coupled to the front panel comprising a locking hole and an attachment panel coupled to the front panel;

an upper telescoping panel;

a lower telescoping panel coupled to the front panel and the upper telescoping panel;

a bottom panel coupled to the front panel; and a rear locking panel coupled to the bottom panel, comprising:

a rear viewing port;

passage tabs; and a locking tongue comprising a locking tab positioned between the passage tabs;

wherein in a closed configuration the blank forms a box defining a cavity and:

the locking tongue of the rear locking panel engages the locking hole of the wing portion;

the bottom panel receives the passage tabs of the rear locking panel to couple the locking tongue to the wing portion;

the cavity is visible through the viewing port of the front panel, and the cavity is visible through the rear viewing port of the rear locking panel.

18. The blank of claim 17, further comprising:

a first wing portion comprising a first side panel and a first rear panel and a second wing portion comprising a second side panel and a second rear panel; and the blank is at least partially defined by the first rear panel of the first wing portion and the second rear panel of the second wing portion.

19. The blank of claim 17, wherein in the closed configuration:

the lower telescoping panel extends into the cavity from a lower telescoping hinge; and the upper telescoping panel extends from the front panel to the rear locking panel and subdivides the cavity.

20. The blank of claim 17, further comprising a partition panel extending from the rear locking panel to the front panel; wherein in the closed configuration:

the partition panel at least partially defines a first cell and a second cell within the cavity;

the lower telescoping panel and the upper telescoping panel together define a first clearance slot and a second clearance slot; and the first clearance slot aligns with the first cell and the second clearance slot aligns with the second cell when the lower telescoping panel and the upper telescoping panel.

* * * * *